US007398734B1

(12) United States Patent
Jean

(10) Patent No.: US 7,398,734 B1
(45) Date of Patent: Jul. 15, 2008

(54) MEMS RESETTABLE TIMER

(75) Inventor: Daniel L. Jean, Odenton, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 71 days.

(21) Appl. No.: 11/374,482

(22) Filed: Mar. 9, 2006

(51) Int. Cl.
*F42C 15/24* (2006.01)

(52) U.S. Cl. ..... 102/249; 102/275.11

(58) Field of Classification Search ..... 102/231–233, 102/247–249, 264, 275.11, 276
See application file for complete search history.

(56) References Cited

U.S. PATENT DOCUMENTS 4,716,830 A * 1/1988 Davis et al. ..... 102/248
4,739,705 A * 4/1988 Hudson et al. ..... 102/222
4,815,381 A * 3/1989 Bullard ..... 102/247
4,876,960 A * 10/1989 Schillinger et al. ..... 102/249
4,986,184 A 1/1991 Kude
5,485,788 A 1/1996 Corney
5,585,592 A * 12/1996 Stearns et al. ..... 102/233
5,693,906 A * 12/1997 Van Sloun ..... 102/251
5,705,767 A 1/1998 Robinson
5,872,324 A * 2/1999 Watson et al. ..... 102/265
6,129,022 A * 10/2000 Hickey et al. ..... 102/221
6,167,809 B1 1/2001 Robinson et al.
6,314,887 B1 11/2001 Robinson
6,401,621 B1 6/2002 Davis et al.
6,431,071 B1 8/2002 Hodge et al.
6,439,119 B1 * 8/2002 Smith et al. ..... 102/221
6,622,629 B2 9/2003 Hodge et al.
6,705,231 B1 * 3/2004 Zacharin ..... 102/231
6,964,231 B1 * 11/2005 Robinson et al. ..... 102/235
7,142,087 B2 * 11/2006 Greywall ..... 337/36
2003/0070571 A1 * 4/2003 Hodge et al. ..... 102/221

* cited by examiner

*Primary Examiner*—Bret Hayes
(74) *Attorney, Agent, or Firm*—Fredric Zimmerman

(57) ABSTRACT

A MEMS resettable timer including a primary inertial element and at least one secondary inertial element, which includes a camming surface. When the secondary inertial element moves, its camming surface engages the camming surface of a locking element to remove it from the notch of a subsequent inertial element. When the primary inertial element is released for movement it activates a resetting arrangement to place the secondary inertial element back to the initial position and prevent further movement of the primary inertial element. The cycle is repeatable to commence some predetermined action.

15 Claims, 9 Drawing Sheets

MEMS RESETTABLE TIMER

STATEMENT OF GOVERNMENT INTEREST

The invention described herein may be manufactured and used by or for the Government of the United States of America for government purposes without the payment of any royalties therefore.

BACKGROUND OF THE INVENTION

Various scenarios exist where it is desirable to delay the initiation of an event until some time after an initial shock or acceleration. By way of example, in order to prevent premature detonation, many munition rounds, such as artillery shells, go through a multi-stage arming sequence after being fired. It is required that the sequence commence only after the shell has been fired, and for this purpose a delay after firing is imposed in the procedure.

One way of providing the necessary delay is by the use of an accelerometer. One problem with the accelerometer, however, is that it requires not only a power supply but a signal processor as well. Such arrangement needs a significant volume to package the necessary components, which is impractical for various situations, including use in a munition round.

Existing mechanical timers can also provide the necessary delay, however, these timers include extensive gearing, escapements and other mechanical parts. These numerous components are not only costly but are relatively large in size and require time consuming assembly.

It is an aspect of the present invention to provide an inexpensive miniature inertial delay device, which can provide a relatively long delay time and can be fabricated utilizing MEMS (micro electromechanical systems) techniques.

SUMMARY OF THE INVENTION

An aspect of an exemplary embodiment of the present invention includes a resettable timer, which includes a primary inertial element and a plurality of secondary inertial elements at an initial position. A locking arrangement prevents movement of all but a first of the inertial elements. Movement of the first inertial element, due to an acceleration of the timer, is operable to commence an unlocking of the locking arrangement to allow sequential movement of the other inertial elements. A reset arrangement is also provided, where movement of the primary inertial element activates the reset arrangement to place the secondary inertial elements back to their initial position, in a first cycle, and prevents further movement of the primary inertial element. The cycle repeats itself at least one more time with continued acceleration until the primary inertial element is no longer restrained from movement. Yet another aspect of an exemplary embodiment of the present invention is an arrangement, which uses only a single secondary inertial element.

BRIEF DESCRIPTION OF THE DRAWINGS

The invention will be better understood, and further aspects will become more apparent from the following description, taken in conjunction with the accompanying drawings, in which.

DETAILED DESCRIPTION OF EXEMPLARY EMBODIMENTS OF THE INVENTION

Figure 1:
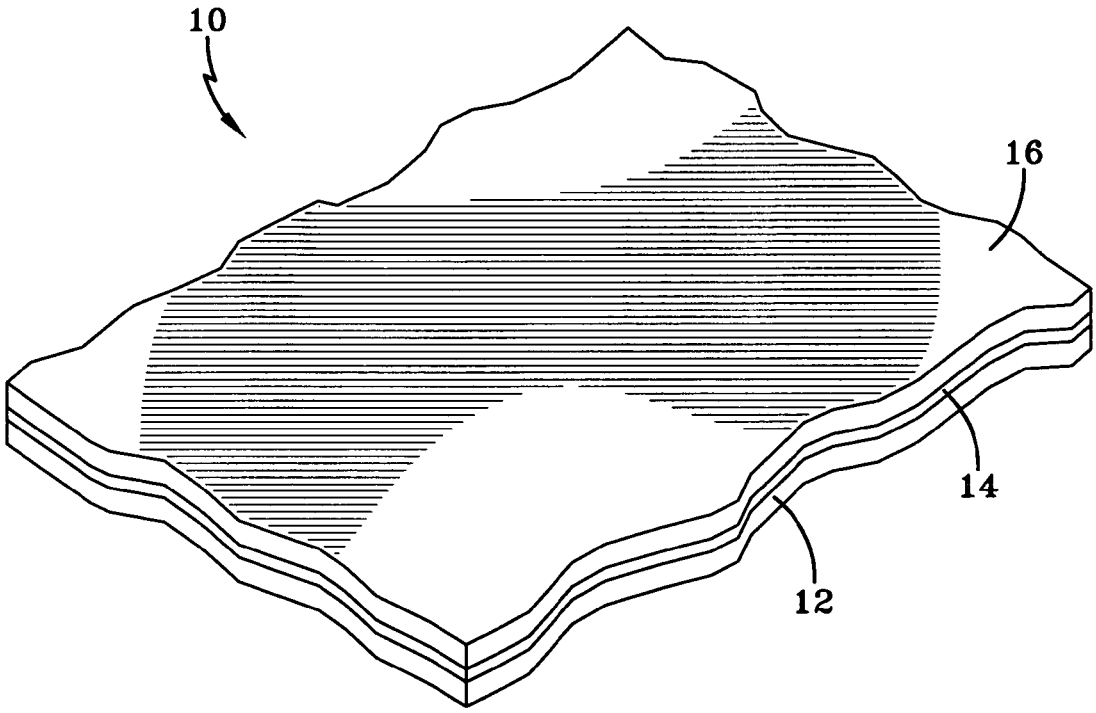
FIG. 1 is a view of an SOI (silicon on insulator) wafer prior to fabrication of the resettable timer.

In the drawings, which are not necessarily to scale, like or corresponding parts are denoted by like or corresponding reference numerals.

FIG. 1 illustrates a portion of an SOI wafer 10 from which the timer of the present invention may be fabricated. The structure of FIG. 1 includes a silicon substrate 12 (also known as a handle layer) covered by an insulating layer 14, such as silicon dioxide, over which is deposited another silicon layer 16 (also known as the device layer), which is the layer from which the timer will be produced.

Figure 2:
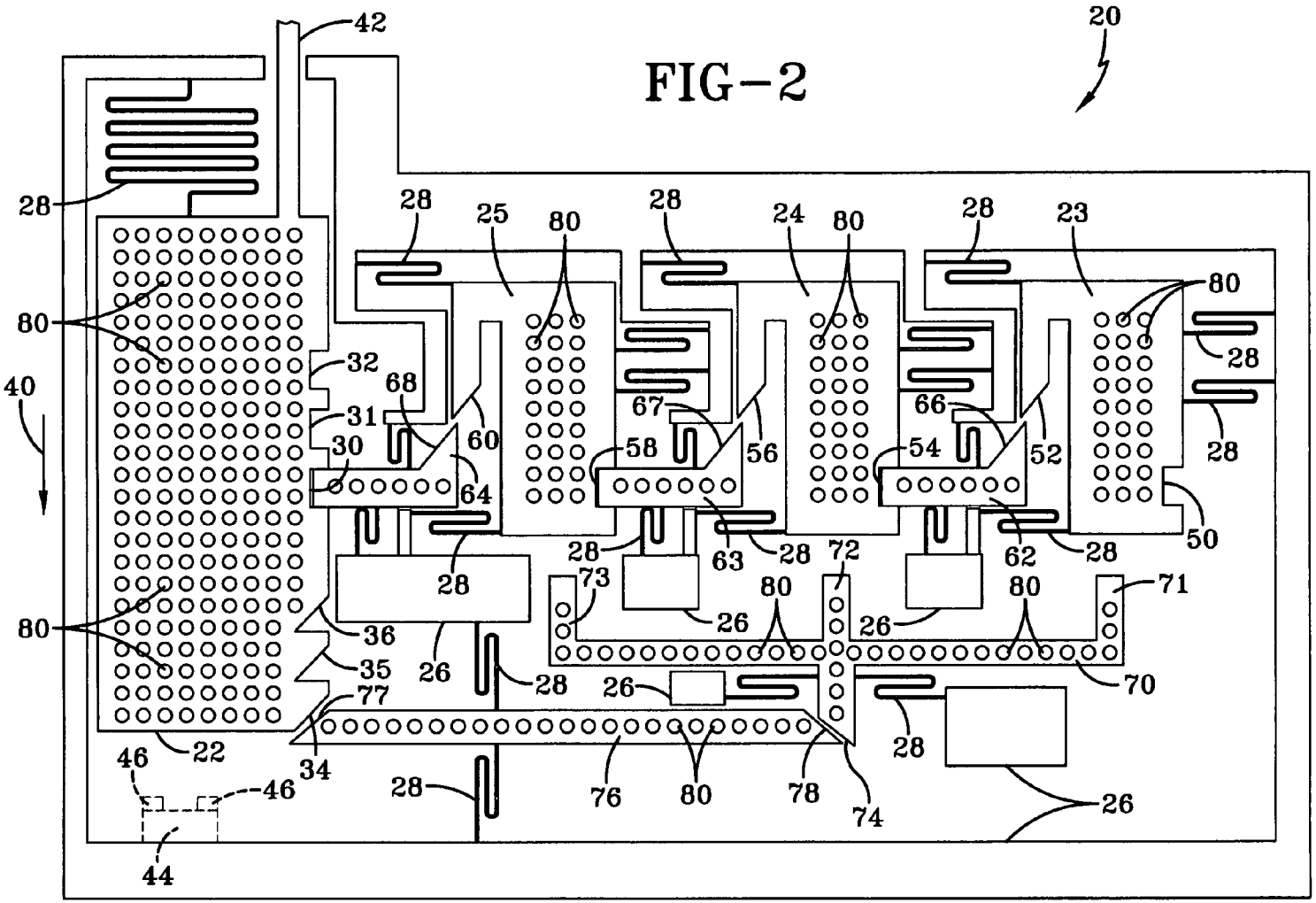
FIG. 2 illustrates an embodiment of the present invention.

FIG. 2 is a view of one embodiment of a timer 20 formed from the wafer 10 of FIG. 1. The timer is formed by a DRIE (deep reactive ion etching) process, which removes unwanted portions of layer 16. The DRIE process is a well developed micromachining process used extensively with silicon based MEMS devices. For this reason silicon is generally a material used for the timer of the present invention, although other materials are possible. Timer 20 is one of a multitude of similar timers fabricated on the same wafer 10, with all of the timers being separated after fabrication for use as individual resettable timers each with the potential for relatively long time delays.

Timer 20 includes a primary inertial element 22 and at least one secondary inertial element of a mass less than a mass of the primary inertial element 22. In the embodiment of FIG. 2, by way of example, three such secondary inertial elements 23, 24 and 25 are illustrated and the mass of primary inertial element 22 is greater than the total mass of all the secondary inertial elements 23, 24 and 25. The inertial elements 22 to 25, as well as other moveable components to be described, are connected to a series of supports 26 by respective springs 28, as illustrated. In an exemplary embodiment, the inertial elements 22 to 25 are each substantially rectangular shaped. The rectangular shape includes a long axis and a perpendicularly oriented shorter axis. The longer axis of each inertial element 22 to 25 is substantially parallel to the longer axis of each of the other inertial elements 22 to 25. In an exemplary embodiment as depicted in FIG. 2, at least two of the inertial elements 24, 25 are situated intermediate the inertial element 23 and the primary inertial element 22.

Primary inertial element 22 includes a plurality of sequentially arranged locking notches 30, 31 and 32 as well as a plurality of sequentially arranged camming surfaces 34, 35 and 36. In an exemplary embodiment, all of the camming surfaces described herein are linear and sloped though other shapes may be used for the camming surfaces. As will be described, unrestrained movement of primary inertial element 22 in the direction of arrow 40 will cause the desired activation of a device. For example, if the timer is used as part of a larger MEMS device, rod 42 attached to the primary inertial element 22 may activate another portion of the overall, larger MEMS device. Activation of a device may also be accomplished electrically. To this end, the arrangement may include an electrical circuit 44, shown dotted, and having contacts 46 which will cause closure of the electric circuit 44 when the primary inertial element 22, which is electrically conducting, touches contacts 46.

The first secondary inertial element 23 includes a locking notch 50 on one side thereof and a camming surface 52 on an opposite side. Similarly, the second and third secondary inertial elements 24 and 25 include a respective locking notch 54 and camming surface 56 for inertial element 24, and locking notch 58 and camming surface 60 for inertial element 25.

The locking arrangement includes a series of locking elements 62, 63 and 64, each including a respective camming surface 66, 67 and 68. Locking element 64 is intermediate the primary inertial element 22 and inertial element 25. Locking elements 62, 63 are respectively located intermediate inertial elements 23, 24 and 25. Each of locking element of the series of locking elements 62, 63 and 64 is intermediate Locking element 62 seats in locking notch 54 of inertial element 24 and prevents it from moving in response to acceleration. Locking element 63 seats in locking notch 58 of inertial element 25 and prevents it from moving, while locking element 64 seats in locking notch 30 of primary inertial element 22 to keep it from moving. In this regard, it is seen that locking notch 50 of inertial element 23 is unused and accordingly it may be omitted from this first inertial element. The timer arrangement additionally includes a reset bar 70 including projections 71, 72 and 73 and camming surface 74 for, as will be seen, resetting inertial elements 23, 24 and 25 back to their initial position. A reset activator member 76 having first and second camming surfaces 77 and 78 is utilized to move the reset bar 70 for its resetting function. Accordingly, the inertial elements 22 to 25 are substantially perpendicular to the reset bar 70 as well as the reset activator member 76.

To operate as an inertial delay device, inertial elements 22 to 25 and springs 28 must be free to move and therefore must be free of any underlying silicon dioxide insulating layer 14 (FIG. 1). One way to accomplish the removal of the underlying insulating layer is by applying an etchant, such as, hydrofluoric acid or a similar material, which will dissolve the silicon dioxide.

The etchant will, in a relatively short period of time, dissolve the insulation beneath the springs 28, since they are of small width, thus freeing them for movement. In order to shorten the time for dissolving the silicon dioxide under inertial elements 22, 23, 24 and 25, as well as under locking elements 62, 63 and 64, reset bar 70 and reset activator member 76, they are provided with a series of apertures 80 which extend from the top surface down to the insulating layer 14, thereby allowing the etchant direct access to the undersurface of these members. Although some of the etchant dissolves the insulation under the supports 26, the process of freeing the inertial elements 22, 23, 24 and 25, locking elements 62, 63 and 64, reset bar 70, reset activator member 76 and springs 28 is completed before the supports 26 are completely freed so that they remain immovable. Accordingly, the reset bar 70 and reset activation member 76 are substantially adjacent inertial elements 22, 23, 24 and 25 as well as locking elements 62, 63 and 64.

Figure 3A:
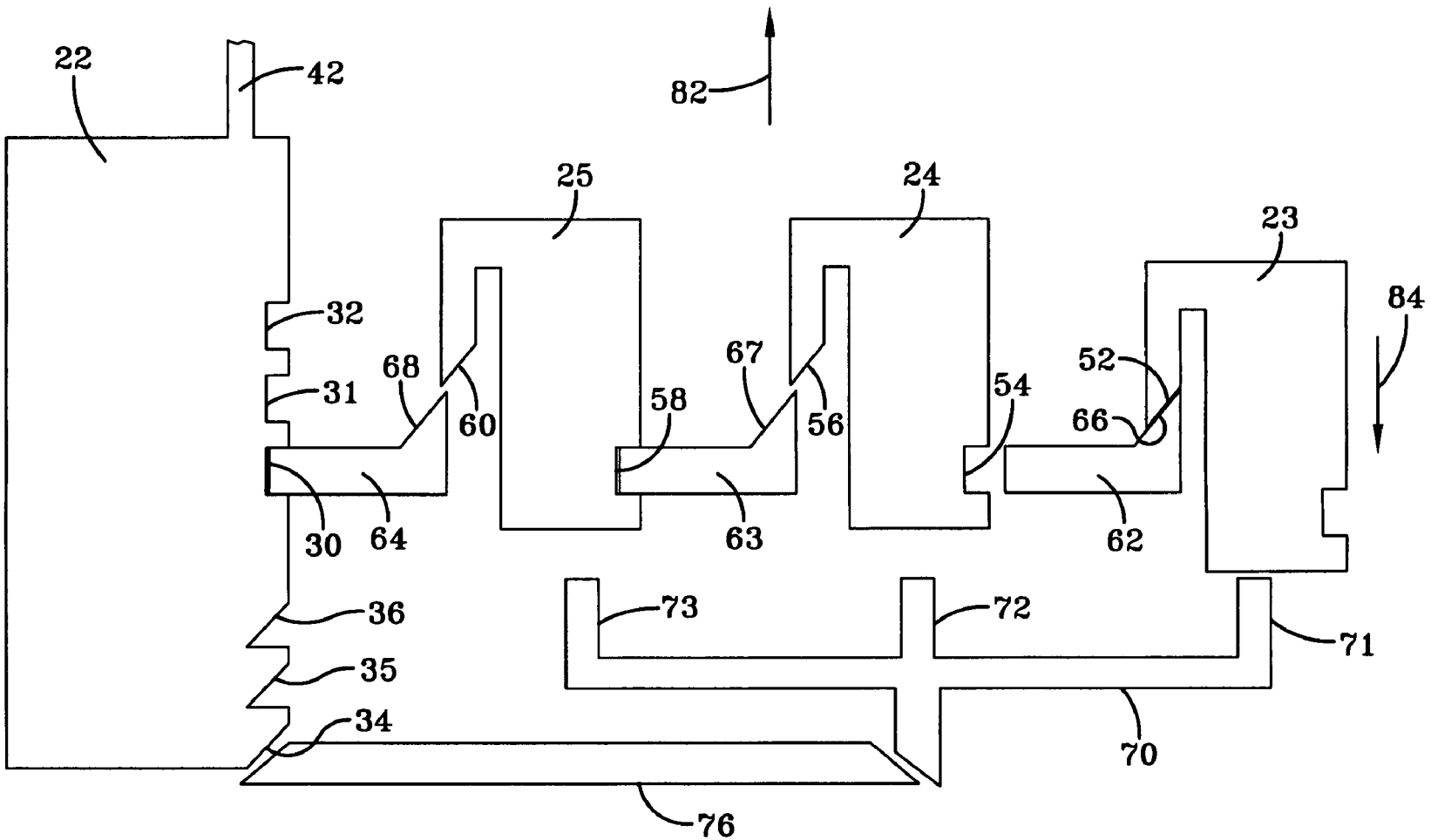
FIGS. 3A to 3G illustrate the operation of the device of FIG. 2.

The operation of timer 20 will now be described with reference to FIGS. 3A to 3G, where, for simplicity and clarity, the supports 26, springs 28 and apertures 80 have not been illustrated. In FIG. 3A, in an exemplary embodiment, in response to an initial shock or acceleration in the direction of arrow 82, the first inertial element 23, since it is not being restrained, that is, moveable or unlocked, will move down (as viewed in FIG. 3A) in the direction of arrow 84. In a different exemplary embodiment, the first inertial element 23 as depicted in FIG. 3A may initially be restrained and unable to move, that is, locked, and an electrical activation device (not shown) may be used to unlock the first inertial element 23 in order to initiate and activate the first inertial element 23.

In an exemplary embodiment of the present invention where the first inertial element 23 is not restrained as indicated above, if the timer 20 is utilized in a munition round, such acceleration may be due to forward acceleration or rotational acceleration, depending on how the timer is oriented within the round. This downward movement causes camming surface 52 of inertial element 23 to engage camming surface 66 of locking element 62 to thereby pull locking element 62 out of its locking engagement with locking notch 54 of inertial element 24.

Figure 3B:
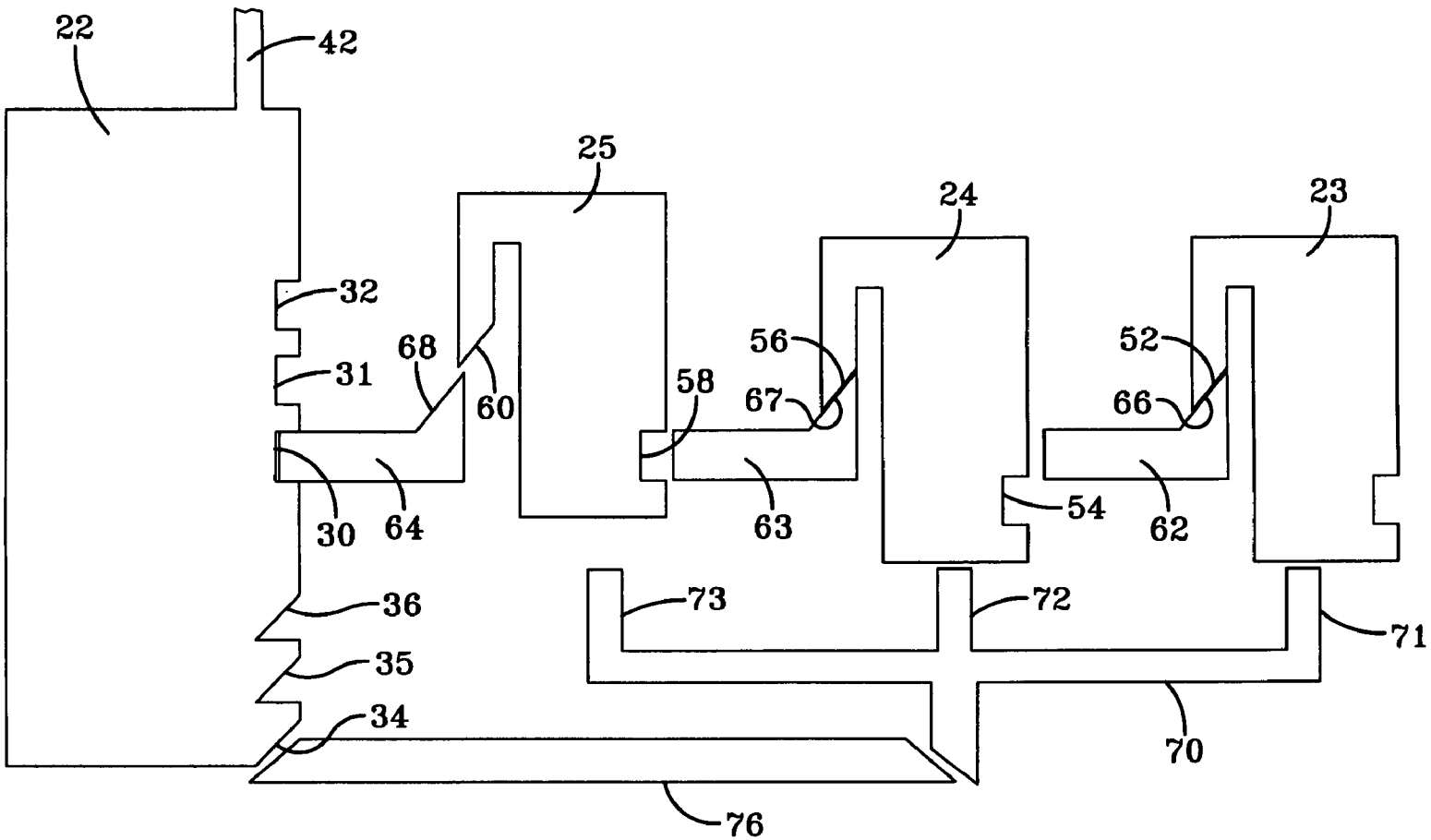

As illustrated in FIG. 3B, the removal of locking element 62 from locking notch 54 allows inertial element 24 to move down. This movement engages camming surface 56 of inertial element 24 with camming surface 67 of locking element 63 thereby withdrawing it from locking notch 58 of inertial element 25, allowing inertial element 25 to move down.

Figure 3C:
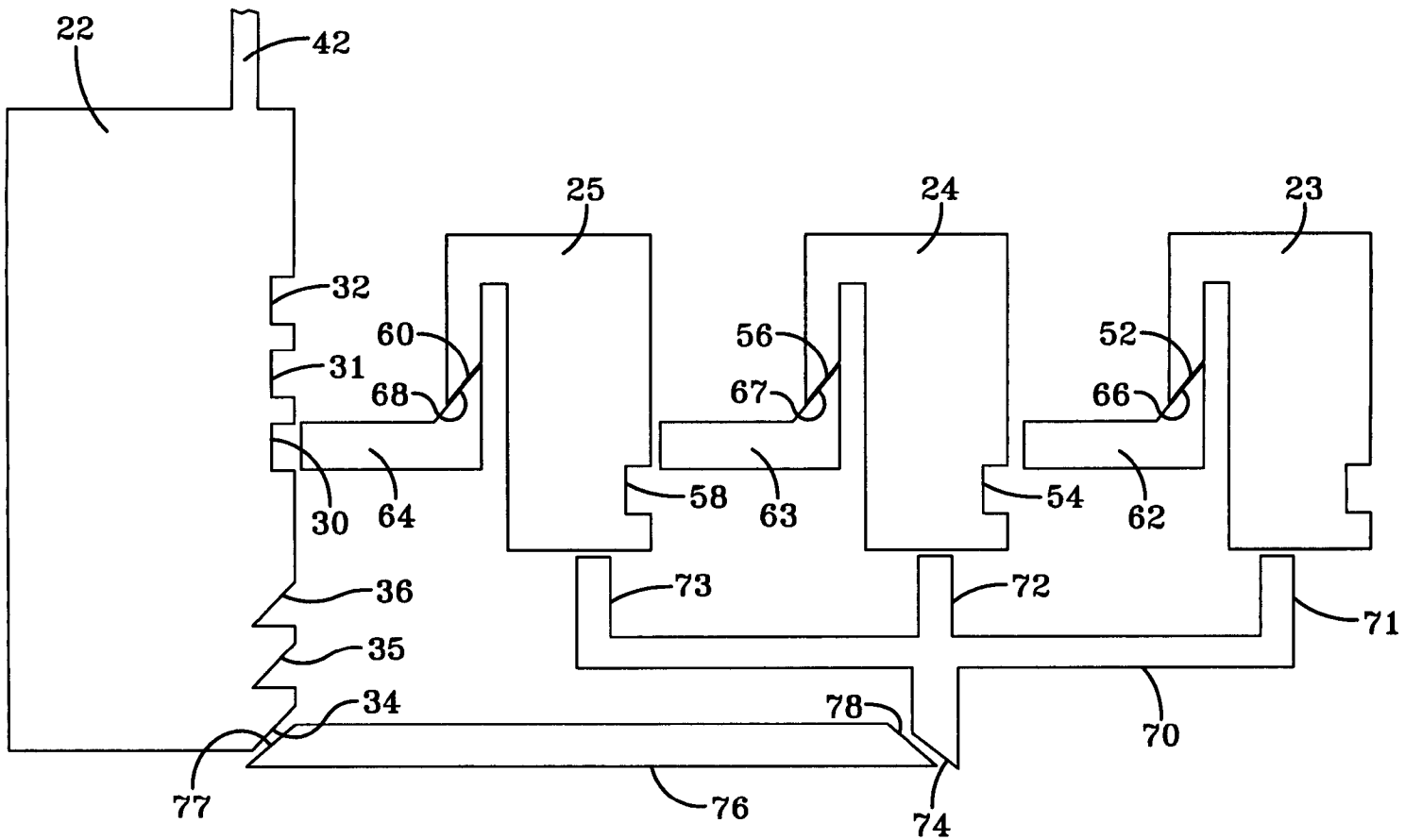

When inertial element 25 moves down, as illustrated in FIG. 3C, its camming surface 60 engages camming surface 68 of the last locking element 64 to withdraw it from locking notch 30 of primary inertial element 22. Accordingly, in an exemplary embodiment, the inertial element 22 is substantially adjacent to the inertial element 25.

Figure 3D:
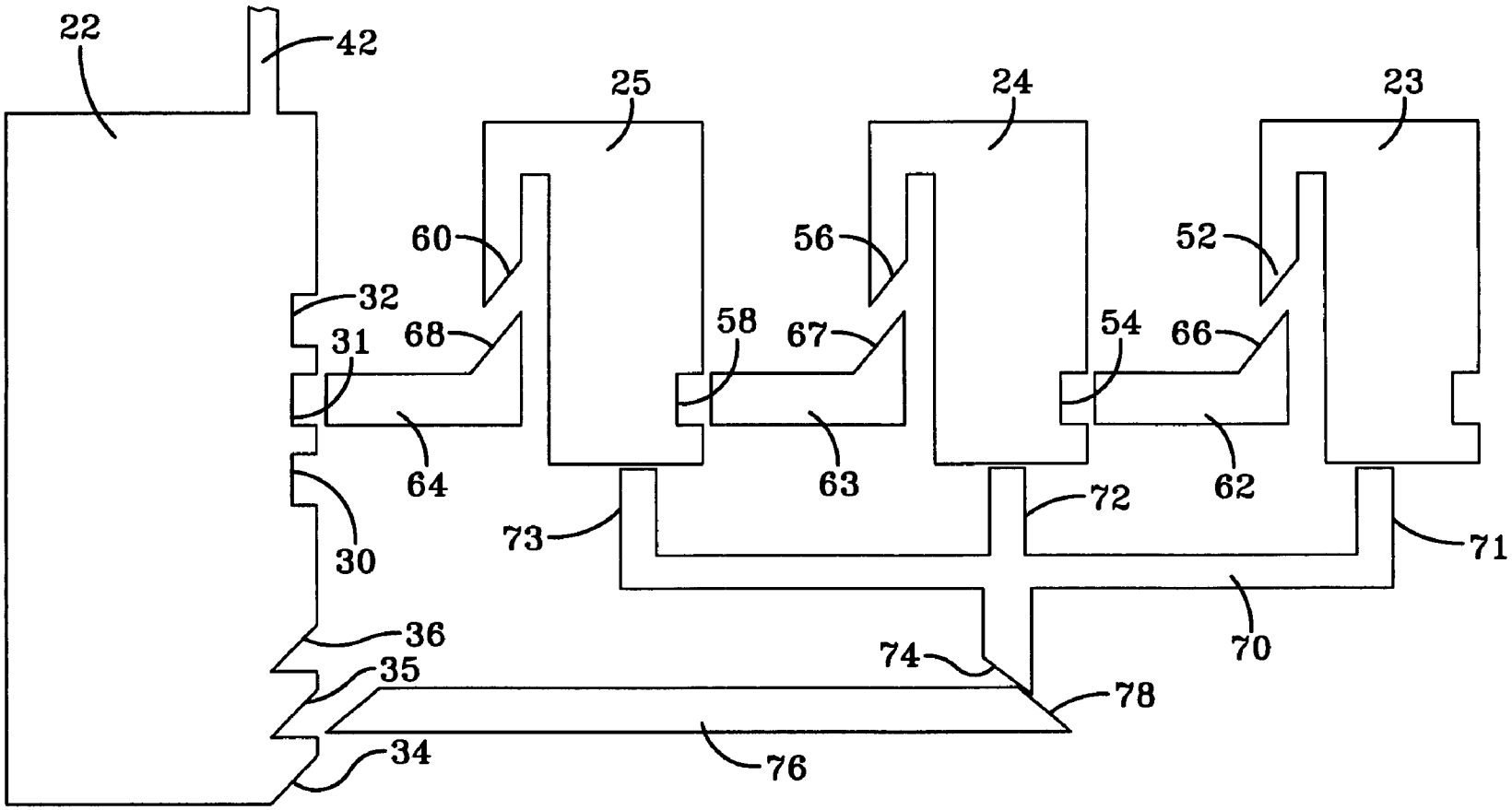
Figure 3E:
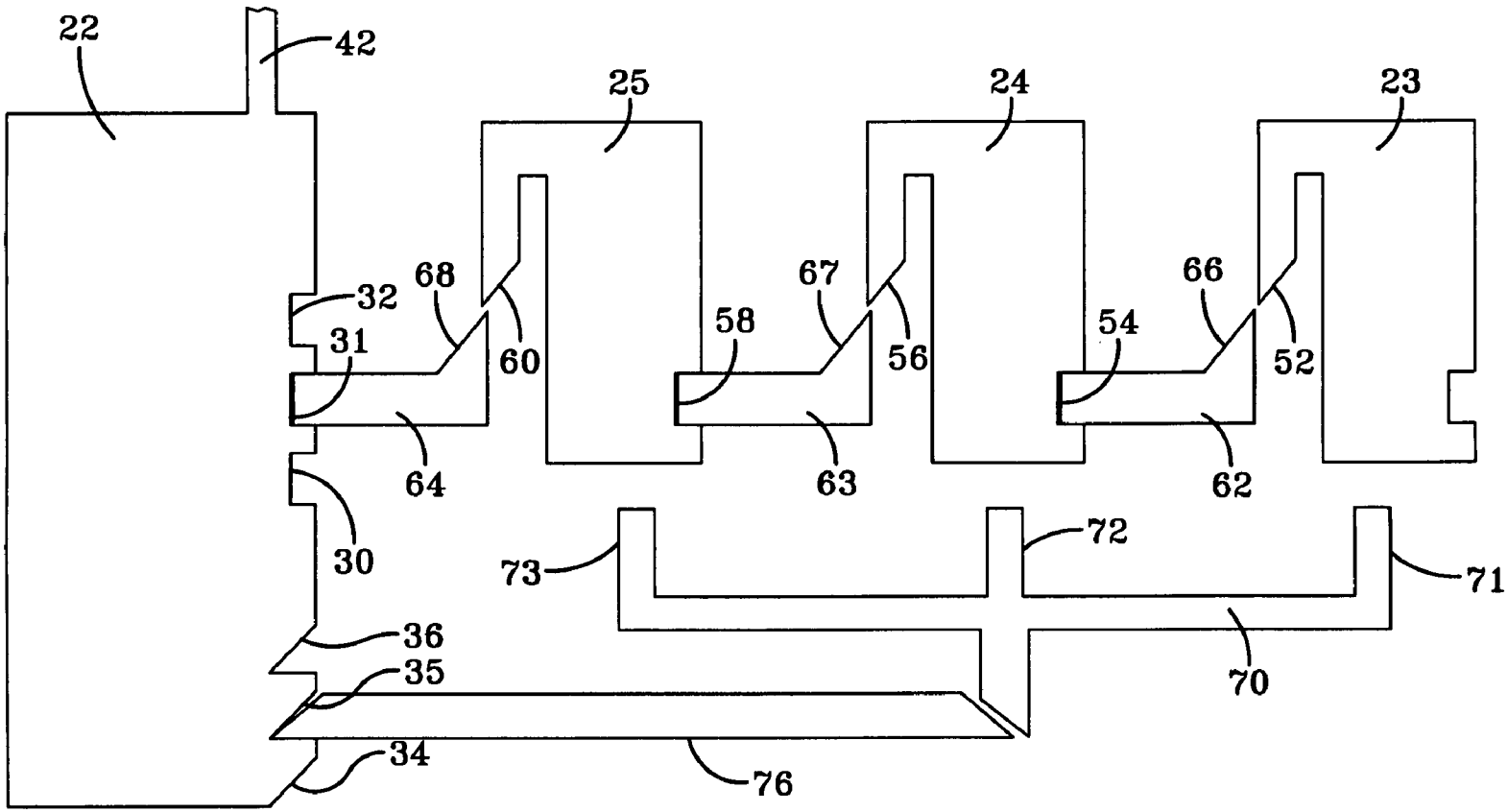

With locking element 64 withdrawn, primary inertial element 22 starts to move down. In so doing, camming surface 34 of primary inertial element 22 engages camming surface 77 of reset activation member 76 causing it to move to the right. As a result, camming surface 78 engages camming surface 74 of reset bar 70 pushing it up so that projections 71, 72 and 73 push against the bottom of respective inertial elements 23, 24 and 25 thus placing them in their initial position. This configuration is depicted in FIG. 3D. This first cycle results not only in a resetting of the inertial elements 23, 24 and 25, but, as shown in FIG. 3E, places locking element 64 within the second locking notch 31 of primary inertial element 22 as well as positioning reset activation member 76 against the second camming surface 35 of primary inertial element 22. Therefore, the inertial elements, 23, 24 and 25, that is, the smaller masses, reset the primary inertial element, 22, that is, the larger mass.

Figure 3F:
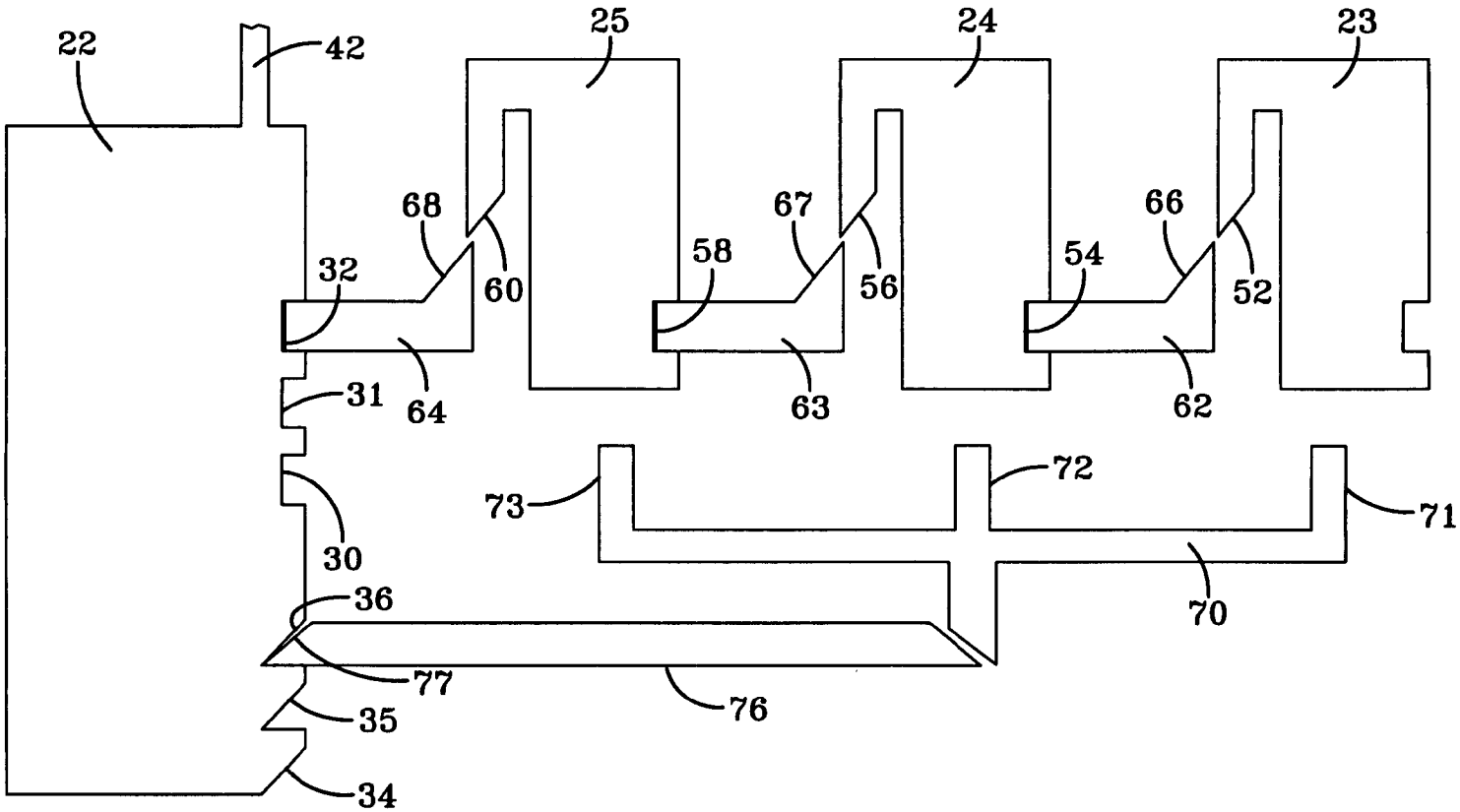

Continued acceleration again causes inertial element 23 to move down where the cycle is repeated ending with the configuration of FIG. 3F. That is, locking element 64 of inertial element 25 is positioned within the last locking notch 32 of primary inertial element 22 and camming surface 77 of reset activation member 76 is positioned against the last camming surface 36 of primary inertial element 22.

Figure 3G:
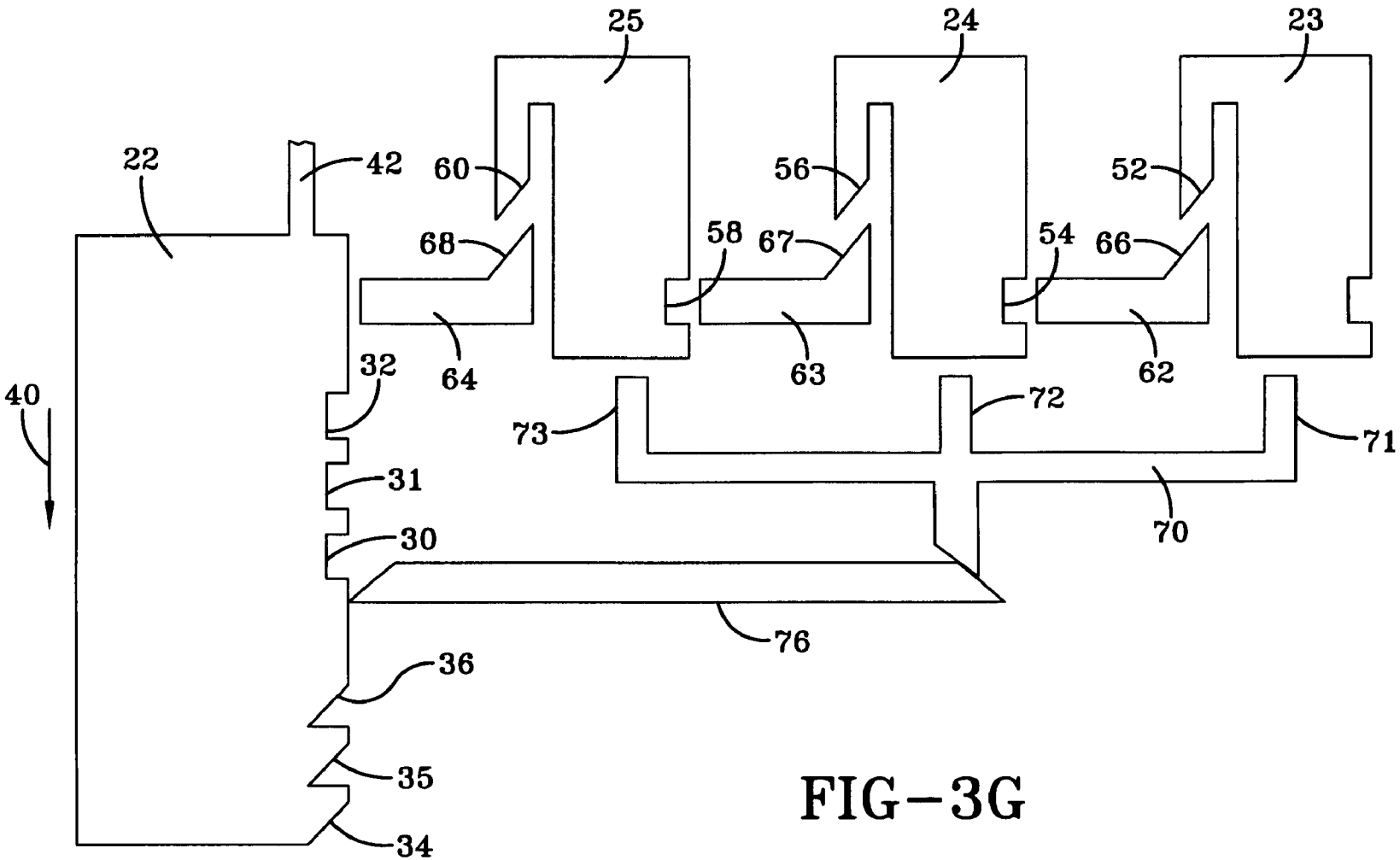

After the next cycle, locking element 64 is withdrawn from the last locking notch 32 of primary inertial element 22 allowing primary inertial element 22 to travel its full extent without impediment, as seen in FIG. 3G, to thereby initiate a predetermined event. To vary the time delay imposed by the timer 20, more or fewer locking notches and camming surfaces may be provided in primary inertial element 22 and more or fewer secondary inertial elements may be provided. Generally, time delays that are possible range from about 0.1 second or less to 10 seconds or more.

In another exemplary embodiment, the above embodiment may be used except one secondary inertial element 25 may be used instead of a plurality of inertial elements 23, 24, and 25. In this embodiment, the sole secondary inertial element 25 is unrestrained, that is, free to move, for example, in response to an initial shock or acceleration as indicated in FIG. 3A. Accordingly, activation of the secondary inertial element 25 causes activation of the primary inertial element 22 as discussed above.

Having thus shown and described what is at present considered to be exemplary embodiments of the present invention, it should be noted that the same has been made by way of illustration and not limitation. Accordingly, all modifications, alterations and changes coming within the spirit and scope of the present invention are herein meant to be included.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A resettable timer, comprising:

a primary inertial element, said primary inertial element including a plurality of sequentially arranged locking notches and a plurality of sequentially arranged camming surfaces;

at least one secondary inertial element being at an initial position;

a locking element being positioned within a first of said plurality of sequentially arranged locking notches to prevent movement of said primary inertial element, said locking element comprising a camming surface, wherein said at least one secondary inertial element includes a camming surface positioned to engage said camming surface of said locking element, in a first cycle, upon a repositioning of said secondary inertial element due to an acceleration of said timer, to withdraw said locking element from said first of said plurality of sequentially arranged locking notches;

a reset bar comprising a camming surface, said reset bar operable to reset said secondary inertial element to said initial position;

a reset activation member comprising a first camming surface, which engages with a first of said plurality of sequentially arranged camming surfaces of said primary inertial element and a second camming surface engageable with said camming surface of said reset bar, wherein when said locking element is withdrawn, said primary inertial element is moved out of position causing said reset activation member to move said reset bar to reset said secondary inertial element to said initial position, and wherein said resetting causes said locking element to position itself in the next of said sequentially arranged locking notches and said first camming surface of said reset activation member to position itself adjacent a second of said sequentially arranged camming surfaces to repeat said cycle until said primary inertial element is no longer restrained from movement;

a plurality of supports; and a plurality of springs connecting said primary inertial element, said at least one secondary inertial element, said locking element, said reset bar and said reset activation member to respective ones of said plurality of supports, wherein said resettable timer is a MEMS timer device.

2. The timer according to claim 1, wherein a mass of said primary inertial element is greater than a mass of said at least one secondary inertial element.

3. The timer according to claim 1, wherein all of said camming surfaces are linear camming surfaces.

4. A resettable timer, comprising:

a primary inertial element, said primary inertial element comprising a plurality of sequentially arranged locking notches and a plurality of sequentially arranged camming surfaces;

a plurality of secondary inertial elements, each at an initial position, wherein each of said plurality of secondary inertial element comprising a camming surface being on one side thereof and at least all but a first of said plurality of secondary inertial elements comprising a locking notch on an opposite side thereof, a plurality of locking elements each comprising a camming surface, a first of said plurality of locking elements being positioned between a first and a second of said plurality of secondary inertial elements and initially engaging a locking notch of said second of plurality of secondary inertial elements, wherein subsequent ones of said plurality of locking elements being positioned between subsequent ones of said plurality of secondary inertial elements and engaging the locking notch of a subsequent of said plurality of secondary inertial elements, a last of said plurality of locking elements engaging the first of said plurality of sequentially arranged locking notches of said primary inertial element to prevent movement thereof, wherein said camming surface of a first of said plurality of secondary inertial elements is operable to engage said camming surface of a first locking element of said plurality of said locking elements, in a first cycle, upon a repositioning of said first of said plurality of secondary inertial elements due to an acceleration of said resettable timer, to withdraw said first locking element from said locking notch of a second of said plurality of secondary inertial elements, and wherein said camming surface of said subsequent of said plurality of secondary inertial elements engaging said camming surfaces of said subsequent ones of said locking elements, with said last of said locking elements is withdrawn from said first of said sequentially arranged locking notches of said primary inertial element in said first cycle;

a reset bar comprising a camming surface, said reset bar operable to reset all of said plurality of secondary inertial elements to their said initial position;

a reset activation member comprising a first camming surface, which engages with a first of said plurality of sequentially arranged camming surfaces of said primary inertial element and a second camming surface engageable with said camming surface of said reset bar, wherein when said locking element is withdrawn from said first locking notch of said primary inertial element, said primary inertial element moves out of position causing said reset activation member to move said reset bar to reset said all of said secondary inertial elements to their said initial positions, and wherein said resetting causes said last of said plurality of locking elements to position itself in the next of said sequentially arranged locking notches and said First camming surface of said reset activation member to position itself adjacent a second of said sequentially arranged camming surfaces to repeat said cycle until said primary inertial element is no longer restrained from movement;

a plurality of supports; and a plurality of springs connecting said primary inertial element, said plurality of secondary inertial elements, said plurality of locking elements, said reset bar and said reset activation member to respective ones of said plurality of supports, wherein said resettable timer is a MEMS timer device.

5. The timer according to claim 4, wherein a mass of said primary inertial element is greater than masses of each of said plurality of secondary inertial elements.

6. The timer according to claim 4, wherein the mass of said primary inertial element is greater than a total mass of all said plurality of secondary inertial elements.

7. A timer, comprising:

a primary inertial element;

a plurality of secondary inertial elements being at an initial position;

a locking arrangement for preventing movement of all but a first inertial element of said plurality of secondary inertial elements; and a reset arrangement, wherein movement of said first inertial element, due to an acceleration of said timer, is operable to commence an unlocking of said locking arrangement to allow sequential movement of said plurality of secondary inertial elements and said primary inertial element, wherein movement of said primary inertial element activates said reset arrangement to place said plurality of secondary inertial elements back to said initial positions, in a first cycle, and prevent further movement of said primary inertial element, wherein said cycle repeating itself at least one more time with continued acceleration until said primary inertial element is no longer restrained from movement, and wherein said timer is a MEMS timer device.

8. A timer, comprising:, a primary inertial element;

a plurality of secondary inertial elements at an initial position;

a locking arrangement where said primary inertial element and said plurality of secondary inertial elements are locked except a first inertial element of said plurality of secondary inertial elements; and a reset arrangement, wherein said plurality of said secondary inertial elements are intermediate said first inertial element and said primary inertial element, wherein a movement of said first inertial element sequentially unlocks said plurality of secondary inertial elements and said primary inertial element before said primary inertial element contacts said reset arrangement, which resets said plurality of secondary elements back to said initial position, and wherein said timer is a MEMS timer device.

9. The timer according to claim 8, wherein said primary inertial element and said plurality of secondary inertial elements are substantially parallel to each other.

10. The timer according to claim 8, wherein said locking arrangement comprises a plurality of locking elements.

11. The timer according to claim 10, wherein one of said plurality of locking elements is intermediate said primary inertial element and one of said plurality of secondary inertial elements.

12. The timer according to claim 10, wherein each of said plurality of secondary inertial elements is separated from another by a locking element of said plurality of locking elements.

13. The timer according to claim 8, wherein said timer is a resettable timer due to said movement of said primary inertial element, said plurality of secondary inertial elements, said locking arrangement and said reset arrangement.

14. A timer, comprising:

a primary inertial element;

at least one secondary inertial element at an initial position;

a locking arrangement intermediate said primary inertial element and said at least one secondary inertial element;

a reset arrangement, wherein said reset arrangement is substantially adjacent said primary inertial element and said at least one secondary inertial element, wherein acceleration of said timer causes said reset arrangement to move said at least one secondary element back to said initial position and inhibit movement of said primary inertial element, and wherein said timer is a MEMS timer device.

15. The timer according to claim 14, wherein said reset arrangement is comprised of a reset bar and a reset activation member.

* * * * *